US012000623B2

(12) United States Patent
Tallakson et al.

(10) Patent No.: US 12,000,623 B2
(45) Date of Patent: Jun. 4, 2024

(54) TABBED BURNER ASSEMBLY

(71) Applicant: Rheem Manufacturing Company, Atlanta, GA (US)

(72) Inventors: Karl S. Tallakson, Greenwood, AR (US); Kenneth D. Frederick, Fort Smith, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 542 days.

(21) Appl. No.: 16/684,232

(22) Filed: Nov. 14, 2019

(65) Prior Publication Data

US 2020/0149749 A1 May 14, 2020

Related U.S. Application Data

(60) Provisional application No. 62/767,419, filed on Nov. 14, 2018.

(51) Int. Cl.

| | |
|---|---|
| ***F24H 9/06*** | (2006.01) |
| ***F24D 5/02*** | (2006.01) |
| ***F24H 3/06*** | (2022.01) |
| ***F24H 9/1854*** | (2022.01) |
| ***F24H 9/1877*** | (2022.01) |
| *F24F 3/06* | (2006.01) |
| *F24F 13/30* | (2006.01) |

(52) U.S. Cl.

CPC ..... *F24H 3/065* (2013.01); *F24D 5/02* (2013.01); *F24H 9/06* (2013.01); *F24H 9/1854* (2013.01); *F24H 9/1877* (2022.01); *F24D 2220/06* (2013.01); *F24F 13/30* (2013.01)

(58) Field of Classification Search

CPC . G06F 1/188; F23D 2900/00017; F24H 9/148

See application file for complete search history.

(56) References Cited

U.S. PATENT DOCUMENTS

| | | | | | |
|---|---|---|---|---|---|
| 4,945,890 | A * | 8/1990 | Ripka | F24H 9/1836 | 126/116 A |
| 5,346,001 | A * | 9/1994 | Rieke | F24H 3/105 | 165/170 |
| 5,346,002 | A * | 9/1994 | Swilik, Jr. | F24H 3/105 | 165/173 |
| 5,815,379 | A * | 9/1998 | Mundt | G06F 1/181 | 361/679.55 |
| 5,975,659 | A * | 11/1999 | Yang | G06F 1/181 | 312/265.5 |

(Continued)

FOREIGN PATENT DOCUMENTS

DE 3533419 A1 * 3/1987

*Primary Examiner* — Jorge A Pereiro

(74) *Attorney, Agent, or Firm* — Eversheds Sutherland (US) LLP

(57) ABSTRACT

A heating, ventilation, and air conditioning system includes a heating system. The heating system portion of the HVAC unit can comprise an array of heat exchanger tubes attached to a first side of a heat exchanger panel and a burner assembly attached to a second side of the heat exchanger panel. The burner assembly can comprise one or more tabs to facilitate installation and removal of the burner assembly within the HVAC system. The heat exchanger panel can comprise one or more slots that receive the one or more tabs of the burner assembly.

11 Claims, 6 Drawing Sheets

(56) References Cited

U.S. PATENT DOCUMENTS 6,164,408 A * 12/2000 Lamm ..... G10K 13/00 181/150
6,215,659 B1 * 4/2001 Chen ..... H05K 7/20172 174/15.1
6,257,682 B1 * 7/2001 Liu ..... G06F 1/184
6,357,652 B1 * 3/2002 Evans ..... B65D 55/06 493/383
6,685,503 B1 * 2/2004 Huang ..... G06F 1/184 439/527
7,054,155 B1 * 5/2006 Mease ..... H05K 7/20581 165/104.34
7,315,457 B1 * 1/2008 Chen ..... G06F 1/184 361/679.01
7,940,525 B2 * 5/2011 Letourneau ..... H05K 7/20172 361/679.48
9,060,441 B2 * 6/2015 Jiang ..... H05K 7/1457
2002/0092516 A1 * 7/2002 Gierula ..... F24H 3/087 126/11 OR
2005/0138944 A1 * 6/2005 Gwin ..... G06F 1/20 62/298
2005/0141191 A1 * 6/2005 Long ..... H05K 7/20172 361/690
2008/0007907 A1 * 1/2008 Lin ..... G06F 1/181 361/825
2008/0148757 A1 * 6/2008 Gwin ..... H05K 7/20172 165/104.33
2008/0283218 A1 * 11/2008 Gwin ..... F28D 15/00 165/80.4
2009/0200832 A1 * 8/2009 Kalus ..... F16B 17/008 296/153
2010/0107397 A1 * 5/2010 Letourneau ..... H05K 7/20172 29/466
2010/0155024 A1 * 6/2010 Gwin ..... G06F 1/20 165/104.34
2013/0252185 A1 * 9/2013 Shaw ..... F23D 14/76 431/178
2015/0338088 A1 * 11/2015 Chase ..... F24H 3/087 126/11 OR
2016/0209055 A1 * 7/2016 Gedcke ..... F24F 1/0323

* cited by examiner

TABBED BURNER ASSEMBLY

RELATED APPLICATIONS

The present application claims priority to U.S. Provisional Patent Application No. 62/767,419 filed Nov. 14, 2018 and titled "Tabbed Burner Assembly," the entire contents of which are incorporated herein by reference.

TECHNICAL FIELD

The present disclosure relates generally to burner assemblies used in heating, ventilation, and air conditioning units.

BACKGROUND

Heating, ventilation, and air conditioning (HVAC) systems often have numerous components that fit together in a complex arrangement. The components of an HVAC system are often in close proximity, which presents challenges for installing or removing components from the HVAC system. For example, if an HVAC system requires maintenance, a technician may encounter challenges in accessing or removing components for servicing or replacement given the complex arrangement and close proximity of the components within the HVAC system.

The following disclosure presents improvements to address the foregoing challenges.

SUMMARY

The present disclosure is directed to a burner assembly for a heating, ventilation, and air conditioning system. In one example embodiment, the heating system portion of the HVAC unit can comprise an array of heat exchanger tubes attached to a first side of a heat exchanger panel and a burner assembly attached to a second side of the heat exchanger panel. The burner assembly can comprise one or more tabs to facilitate installation and removal of the burner assembly within the HVAC system. The heat exchanger panel can comprise one or more slots that receive the one or more tabs of the burner assembly to facilitate installation and removal of the burner assembly from the HVAC system.

In another example embodiment, a heating system can comprise an array of heat exchanger tubes attached to a first side of a heat exchanger panel and a burner assembly attached to a second side of the heat exchanger panel. The burner assembly can comprise one or more tabs to facilitate installation and removal of the burner assembly within the heating system. The heat exchanger panel can comprise one or more slots that receive the one or more tabs of the burner assembly to facilitate installation and removal of the burner assembly from the heating system.

These and other aspects, features, and embodiments of the disclosure will become apparent to a person of ordinary skill in the art upon consideration of the following brief description of the figures and detailed description of illustrated embodiments.

BRIEF DESCRIPTION OF THE DRAWINGS

Reference will now be made to the accompanying drawings, which are not necessarily drawn to scale. The drawings illustrate only example embodiments of an HVAC unit with a heating subsystem. Therefore, the example embodiments of the drawings are not to be considered limiting in scope, as the heating subsystem can be applied to a variety of devices. The elements and features shown in the drawings are not necessarily to scale, emphasis instead being placed upon clearly illustrating the principles of the example embodiments. Additionally, certain dimensions or positions may be exaggerated to help visually convey such principles.

DESCRIPTION OF EXAMPLE EMBODIMENTS

The example embodiments discussed herein are directed to systems, apparatuses, and methods for burner assemblies of heating systems. The following embodiments are non-limiting examples and those working in this field should understand that various modifications can be applied to the examples described herein without departing from the scope of this disclosure. For instance, while the example burner assembly of heating subsystem described herein is shown installed in an HVAC unit, the burner assembly described herein can also be used in other types of heating units.

Example embodiments of a heating subsystem of an HVAC unit will be described more fully hereinafter with reference to the accompanying drawings that describe representative embodiments of the present technology. If a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

The heating subsystem of the present disclosure may be embodied in many different forms and should not be construed as limited to the embodiments set forth herein; rather, these embodiments are provided so that this disclosure will be thorough and complete, and will fully convey the scope of the technology to those appropriately skilled in the art. Further, example embodiments of the heating subsystem of the present disclosure can be disposed in a heating system or an HVAC unit that is located in any type of environment (e.g., warehouse, attic, garage, storage, mechanical room, basement) for any type (e.g., commercial, residential, industrial) of user.

Figure 1:
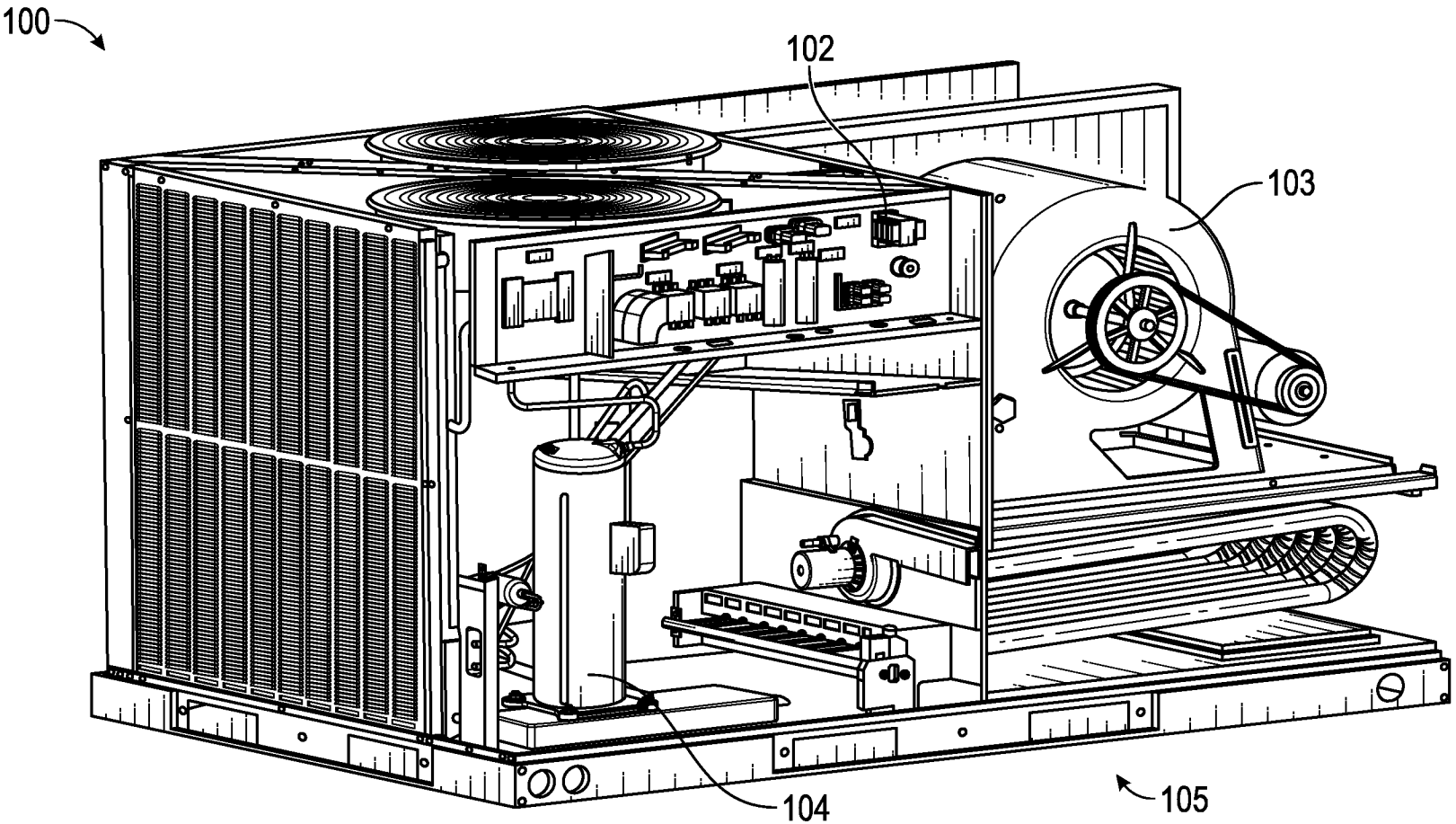
FIG. 1 is a perspective illustration of the components of an HVAC unit in accordance with the example embodiments of the disclosure.

Referring to FIG. 1, an example HVAC unit 100 is illustrated with outer panels removed so that the interior components of the HVAC unit 100 can been shown. Certain of the primary components of the HVAC unit 100 are identified in FIG. 1, including the control panel 102, the blower unit 103, the compressor 104, and the heating system 105. The control panel 102 can comprise a controller that receives inputs from a thermostat and controls the operation of the HVAC unit 100. The blower unit 103 is used to provide cooled or heated air to an enclosed space. The compressor 104 is part of the cooling system of the HVAC unit and compresses a refrigerant for cooling air that is circulated by the blower unit 103.

Figure 2:
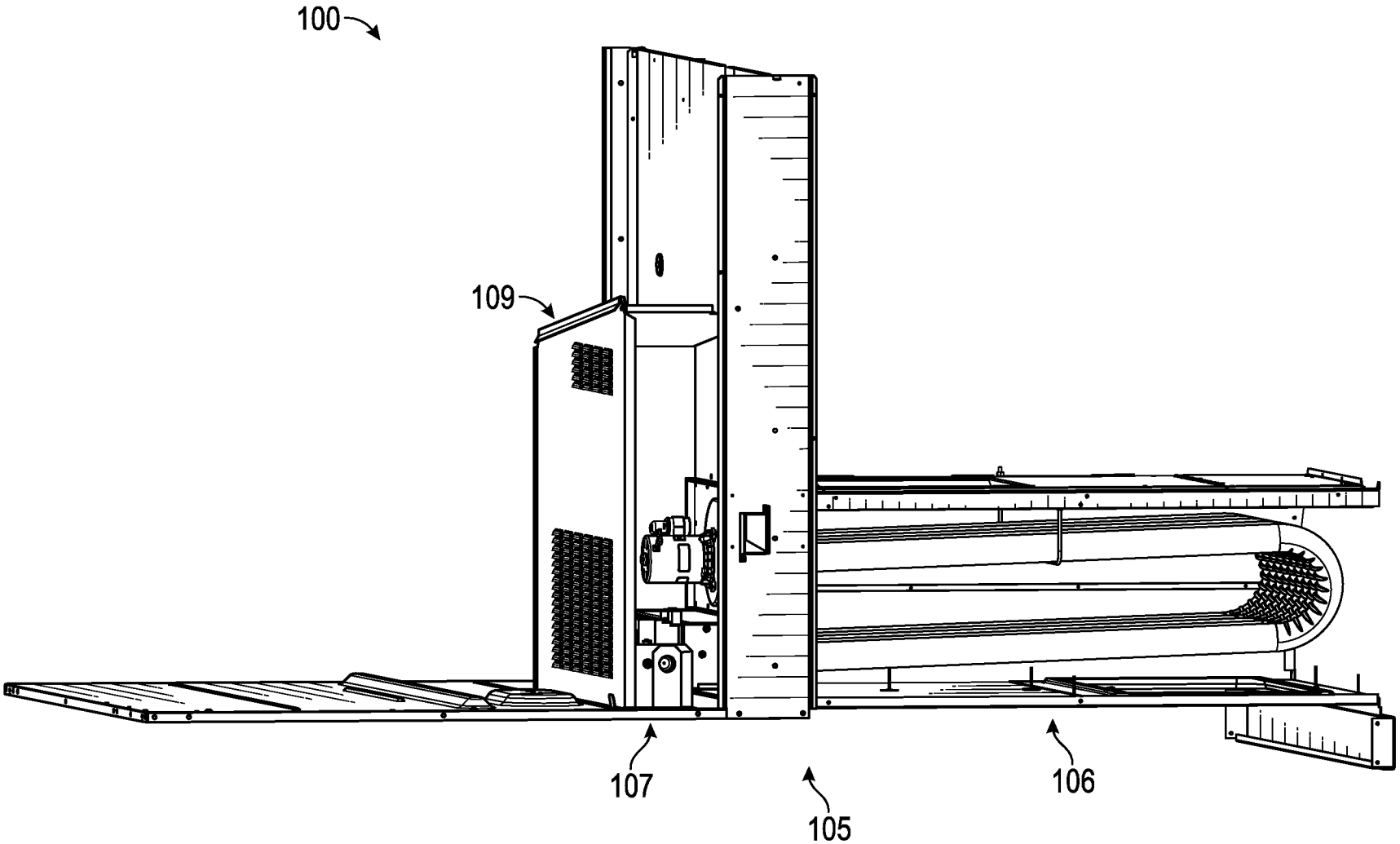
FIG. 2 is a perspective illustration of the components of the heating system of the HVAC unit of FIG. 1 in accordance with example embodiments of the disclosure.

Referring to FIG. 2, the heating system 105 has been isolated from the remainder of the HVAC unit 100 in order to focus on the primary components of the heating system 105. The example heating system 105 includes a burner assembly 107 and panels 109 enclosing the burner assembly 107. The burner assembly 107 is attached to one side of a heat exchanger panel and an array of heat exchanger tubes 106 are attached to the opposite side of the heat exchanger panel. During operation of the heating system 105, gas is supplied to the burner assembly 107 where it is combusted to produce a heated combustion gas. The heat exchanger panel is generally planar and prevents the heated combustion gas from flowing to the blower unit 103. Instead, the heated combustion gas is drawn through the heat exchanger panel 112 and through the heat exchanger tubes 106 by an induction fan 108. The heated combustion gas passing through the inside of the heat exchanger tubes 106 can be used to heat air that passes over the outside of the heat exchanger tubes 106. The heated air that passes over the outside of the heat exchanger tubes 106 is then circulated by the blower unit 103 to heat a space such as a room in a building.

Figure 3:
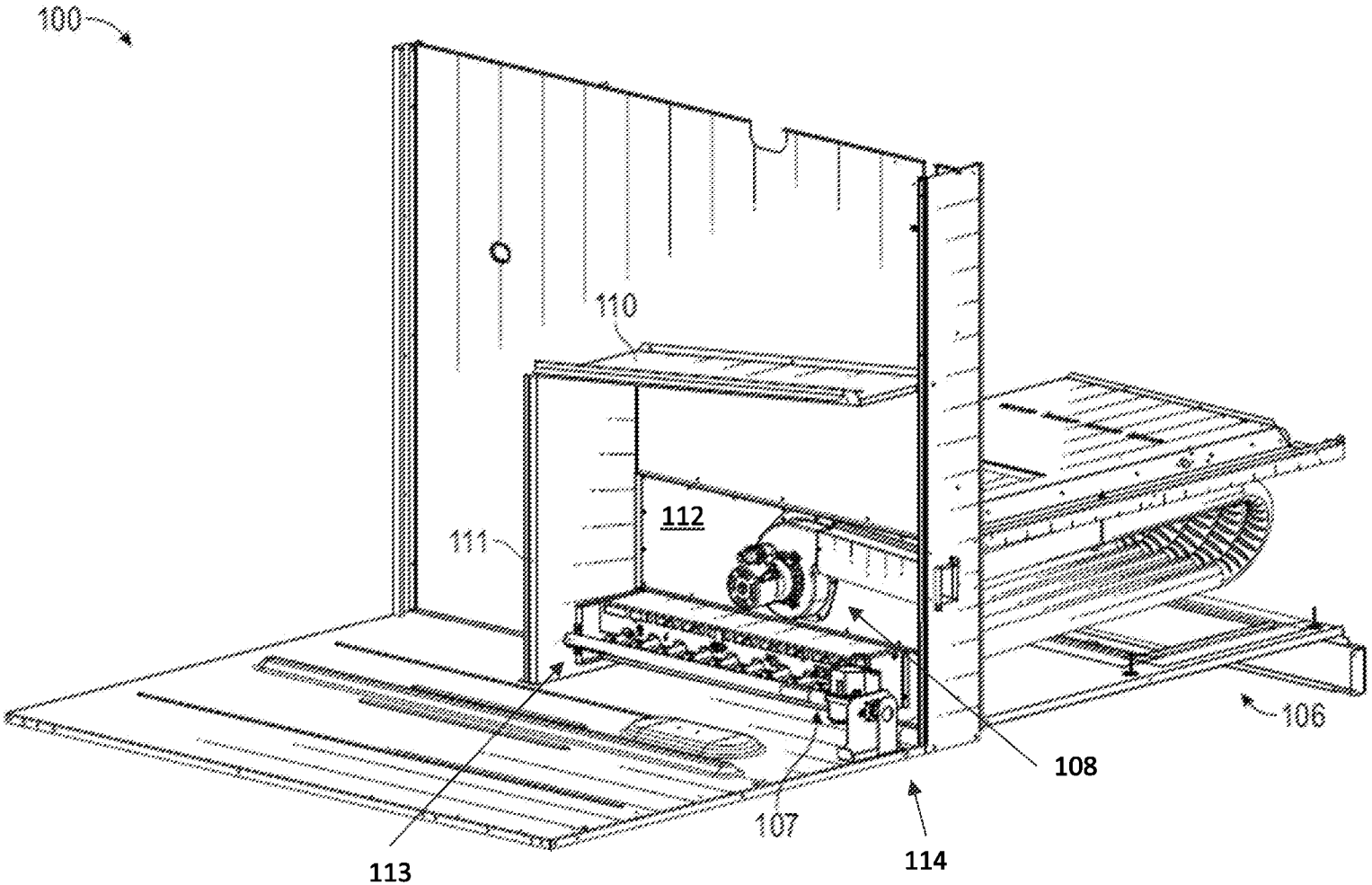
FIG. 3 is another perspective illustration of the components of the heating system of the HVAC unit of FIG. 1 in accordance with example embodiments of the disclosure.

Referring now to FIG. 3, one of the panels 109 has been removed to show the burner assembly 107 in greater detail. As shown in FIG. 3, the burner assembly 107 is mounted on one side of the heat exchanger panel 112 and is partially enclosed by a side panel 111 and a top panel 110. Additionally, the induction fan 108 is located directly above the burner assembly 107. The positions of the side panel 111, the top panel 110, and the induction fan 108 can make it challenging to access the burner assembly 107 for maintenance or removal. In particular, in prior art versions of such an HVAC unit, the burner assembly 107 would typically be fastened to the heat exchanger panel 112 using screws. To unfasten the screws securing the burner assembly 107 to the heat exchanger panel 112, a technician would be required to climb into the HVAC unit in order to access and loosen the screws on the inner side 113 of the burner assembly 107.

Figure 4:
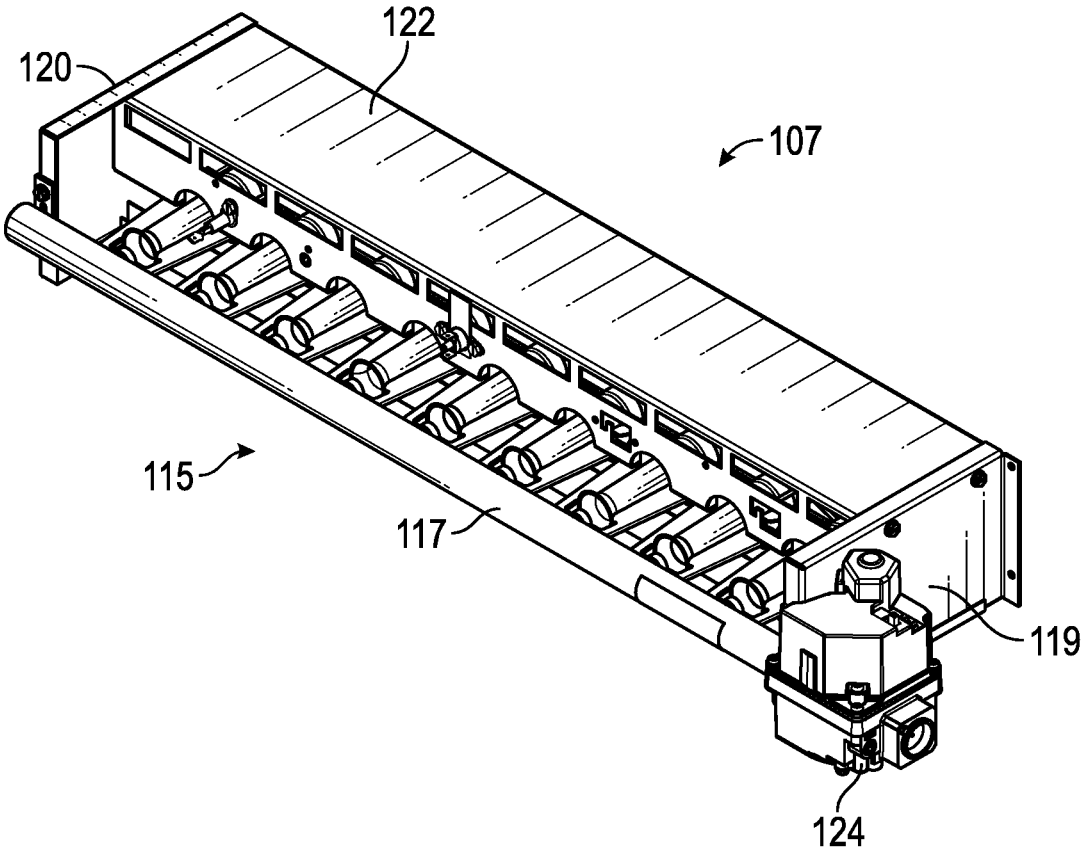
FIG. 4 is a perspective view of the burner assembly in accordance with the example embodiments of this disclosure.
Figure 5:
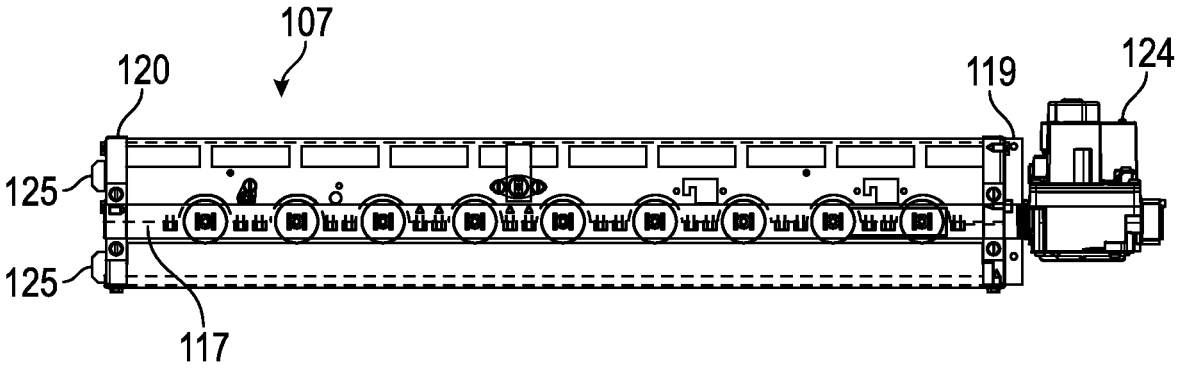
FIG. 5 is a front view of the burner assembly in accordance with the example embodiments of this disclosure.

The foregoing challenge associated with accessing and removing the burner assembly 107 can be addressed with the example embodiments illustrated in FIGS. 4-9. FIG. 4 shows a detailed perspective view of the example burner assembly 107 and FIG. 5 shows a detailed front view of the example burner assembly 107. The burner assembly includes a gas control assembly 124 that controls the flow of gas into a manifold 117 and to the array of burners 115. The array of burners 115 are surrounded by a burner support 122, an inner side bracket 120 (also referred to as a side bracket or first side bracket), and an outer side bracket 119 (also referred to as a side bracket or a second side bracket). The burner support 122 has a box shape that surrounds the top and bottom sides of the array of burners 115. The inner side bracket 120 and the outer side bracket 119 each have a rectangular shape and fit on opposite ends of the burner support 122.

As shown in FIG. 5, the inner side bracket 120 further comprises a pair of tabs 125. In the example shown in FIG. 5, the tabs extend from the inner side bracket 120 in a direction away from the burner support 119. In the example shown in FIG. 5, the tabs 125 are located at an end of the inner side bracket 120 that is closest to the heat exchanger panel 112 when the burner assembly 107 is mounted to the heat exchanger panel 112. In alternate embodiments, the burner assembly 107 can include only one tab or more than two tabs and the tabs can be positioned at other locations on the burner assembly 107.

Figure 6:
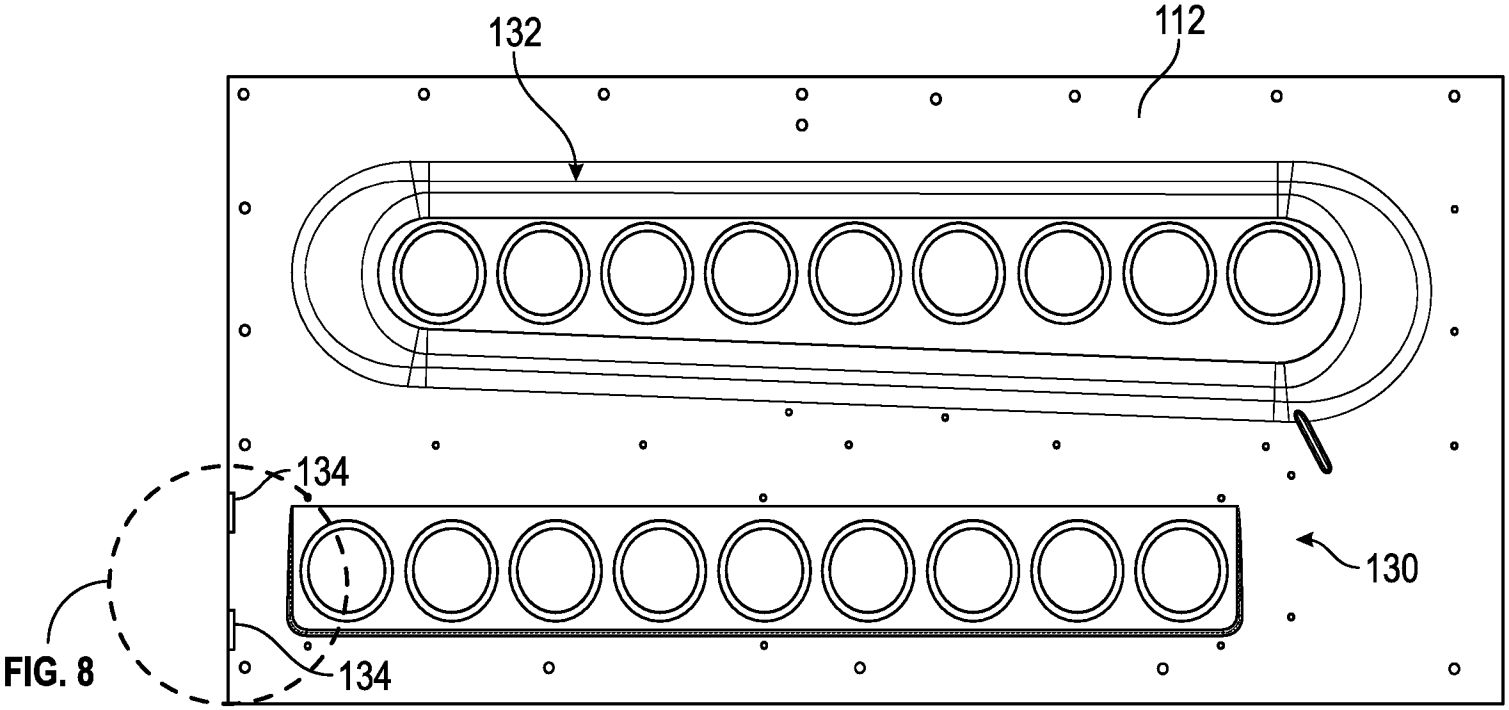
FIGS. 6, 7, 8, and 9 are various views of the heat exchanger panel to which the burner assembly attaches in accordance with the example embodiments of this disclosure.
Figure 7:
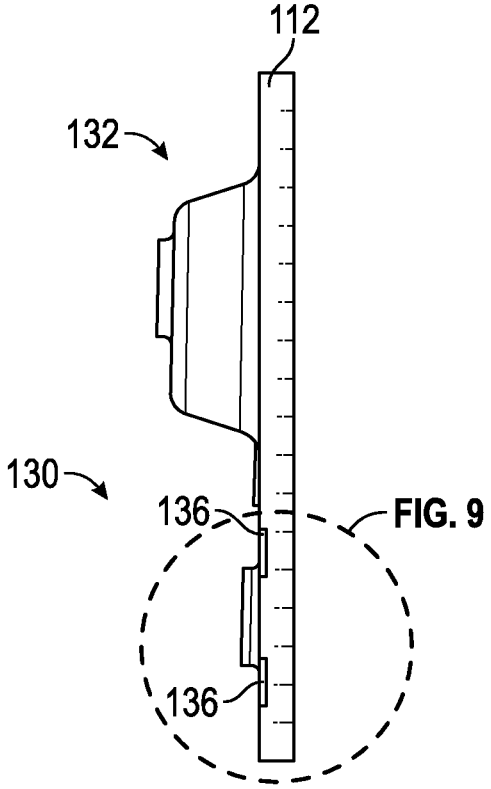
Figure 8:
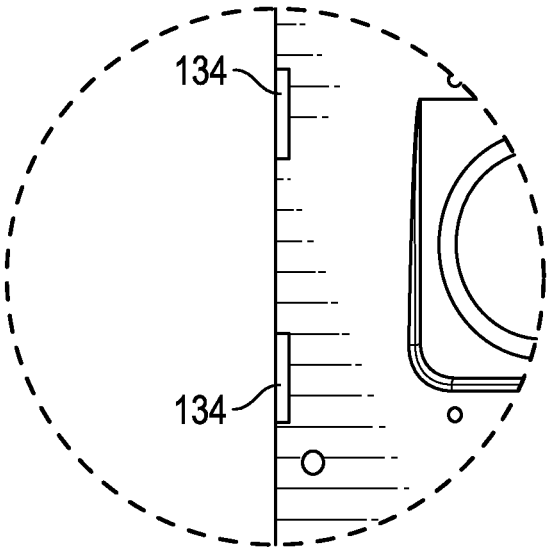
Figure 9:
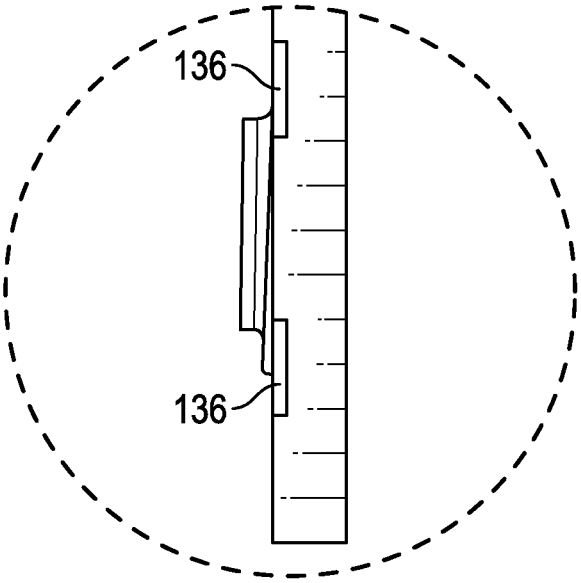

Referring now to FIGS. 6-9, views of the heat exchanger panel 112 are shown. FIG. 6 shows the front surface side of the heat exchanger panel 112 and FIG. 7 shows an inner side view of the heat exchanger panel 112. FIGS. 8 and 9 are detailed views of the portions indicated in FIGS. 6 and 7. The heat exchanger panel 112 includes heat exchanger inlet ports 130 and heat exchanger outlet ports 132. On the front surface side of the heat exchanger panel 112, the heat exchanger inlet ports 130 align with the array of burners 115 to receive the hot combustion gases. Also on the front surface side of the heat exchanger panel 112, the induction fan 108 and a cover panel (as shown in FIG. 3) are positioned over the heat exchanger outlet ports 132. Opposite the front surface side is the rear surface side of the heat exchange panel 112 to which the array of heat exchanger tubes 106 are attached as shown in FIGS. 2 and 3.

The front surface of the heat exchanger panel 112 also comprises front surface slots 134 located towards the inner side of the heat exchanger panel 112. As shown in FIG. 7, the inner side surface of the heat exchanger panel 112 comprises side surface slots 136. In the example provided in FIGS. 6-9, the front surface slots 134 comprise an upper slot and a lower slot and the side surface slots 136 comprise an upper slot and a lower slot. It should be understood that in alternate embodiments there can be fewer or more slots in the heat exchanger panel 112 to accommodate a different number of tabs on the burner assembly. Additionally, in other embodiments, the slots can only be located on the front surface or only located on the side surface of the heat exchanger panel 112 or the slots can be positioned in other locations.

The arrangement of the tabs 125 and the slots 134 and 136 allows a person to install the burner assembly 107 so that the edges of the tabs 125 can first slide into the front surface slots 134. The person can then pivot the burner assembly 107 so that it is positioned against the heat exchanger panel 112 and the pivoting motion causes the tabs 125 to continue to slide into the side surface slots 136. The installation of the burner assembly is then completed by securing the outer side 114 of the burner assembly 107 to the heat exchanger panel 112 using appropriate fasteners. The foregoing steps can be performed in the reverse order to remove the burner assembly 107 from the HVAC unit 100. The sliding motion of the tabs 125 in the slots 134 and 136 permits installation and removal of the burner assembly 107 without requiring that a person climb into the HVAC unit 100 to loosen fasteners on the inner side 113 of the burner assembly 107.

The components of the foregoing example embodiments can be pre-fabricated or specifically generated (e.g., by shaping a malleable body) for a particular heat exchanger, heating system, and/or environment. The components of the example embodiments described herein can have standard or customized features (e.g., shape, size, features on the inner or outer surfaces). Therefore, the example embodiments described herein should not be considered limited to creation or assembly at any particular location and/or by any particular person.

The heating systems described herein and the components therein can be made of one or more of a number of suitable materials and/or can be configured in any of a number of ways to allow the heating system to meet certain standards and/or regulations while also maintaining reliability, regardless of the one or more conditions under which the heating system can be exposed. Examples of such materials can include, but are not limited to, aluminum, stainless steel, ceramic, fiberglass, glass, copper, and plastic.

The example components of the water heating devices and heat exchangers described herein can be made from a single piece (e.g., as from a mold, injection mold, die cast, 3-D printing process, extrusion process, stamping process, crimping process, and/or other prototype methods). In addition, or in the alternative, the example components of the water heating devices and heat exchangers described herein can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

As used herein, a coupling feature can couple, secure, fasten, abut, and/or perform other functions aside from merely coupling. A coupling feature as described herein can allow one or more components of a heating system to become coupled, directly or indirectly, to another portion (e.g., an inner surface) of the heating system. One portion of an example heating system can be coupled to a component and/or another portion of the heating system by the direct use of one or more coupling features.

In addition, or in the alternative, a portion of an example heating system can be coupled to another component and/or another portion of the heating system using one or more independent devices that interact with one or more coupling features disposed on a component of the heating system. Examples of such devices can include, but are not limited to, a weld, a pin, a hinge, a fastening device (e.g., a bolt, a screw, a rivet), epoxy, adhesive, and a spring. A complementary coupling feature as described herein can be a coupling feature that mechanically couples, directly or indirectly, with another coupling feature.

Heating systems can be subject to complying with one or more of a number of standards, codes, regulations, and/or other requirements established and maintained by one or more entities. Examples of such entities can include, but are not limited to, the American Society of Mechanical Engineers (ASME), American National Standards Institute (ANSI), Canadian Standards Association (CSA), the Tubular Exchanger Manufacturers Association (TEMA), the American Society of Heating, Refrigeration and Air Conditioning Engineers (ASHRAE), Underwriters' Laboratories (UL), the National Electric Code (NEC), the Institute of Electrical and Electronics Engineers (IEEE), and the National Fire Protection Association (NFPA). The example heating systems described herein allow the heating system to continue complying with such standards, codes, regulations, and/or other requirements. In other words, the example heating systems described herein do not compromise compliance with any applicable codes and/or standards.

Terms such as "first," "second," "top," "bottom," "left," "right," "end," "back," "front," "side", "length," "width," "inner," "outer," "above", "lower", and "upper" are used merely to distinguish one component (or part of a component or state of a component) from another. Such terms are not meant to denote a preference or a particular orientation unless specified and are not meant to limit embodiments of heating systems. In the foregoing detailed description of the example embodiments, numerous specific details are set forth in order to provide a more thorough understanding of the disclosure. However, it will be apparent to one of ordinary skill in the art that the example embodiments may be practiced without these specific details. In other instances, well-known features have not been described in detail to avoid unnecessarily complicating the description.

While example embodiments of heating systems are discussed herein, the principles of the described embodiments can be applied to a variety of types of heating systems. Accordingly, many modifications of the embodiments set forth herein will come to mind to one skilled in the art having the benefit of the teachings presented in the foregoing descriptions and the associated drawings. Therefore, it is to be understood that heating systems are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A heating, ventilation, and air conditioning (HVAC) unit comprising a heating system, the heating system comprising:

an array of heat exchanger tubes attached to a first side of a heat exchanger panel; and a burner assembly attached to a second side of the heat exchanger panel, the burner assembly mounted to the heat exchanger panel by a first tab and a second tab, wherein the first tab and the second tab are configured to slide into (i) a first upper portion and a first lower portion of a front slot formed along a front surface of the heat exchanger panel, and wherein the first tab and the second tab are configured to pivot and slide into (ii) a second upper portion and a second lower portion of a side slot formed along a side surface of the heat exchanger panel;

wherein the first tab and the second tab mount the burner assembly to the heat exchanger panel on an inner side of the burner assembly, and wherein a different fastener mounts the burner assembly to the heat exchanger panel on an outer side of the burner assembly;

wherein the first bracket is a side bracket of the burner assembly, wherein the side bracket is substantially parallel with the side surface of the heat exchanger panel.

2. The HVAC unit of claim 1, wherein the first tab comprises a first upper tab that engages the first upper portion, and the second tab comprises a first lower tab that engages the first lower portion.

3. The HVAC unit of claim 2, wherein the first tab fits into a first upper slot on the front surface of the heat exchanger panel, and the second tab fits into a second lower slot on the side surface of the heat exchanger panel.

4. The HVAC unit of claim 1, wherein the burner assembly is partially enclosed by a side panel and a top panel mounted to the front surface of the heat exchanger panel, and an induction fan, wherein the side panel is mounted to a bottom of the HVAC unit.

5. The HVAC unit of claim 1, wherein the burner assembly comprises:

an array of burners enclosed within a burner support, wherein the first bracket is attached to a first side of the burner support, and wherein the second bracket is attached to a second side of the burner support.

6. The HVAC unit of claim 1, wherein the first tab and the second tab are a different type of tab than the different fastener.

7. A heating system comprising:

an array of heat exchanger tubes attached to a first side of a heat exchanger panel; and a burner assembly attached to a second side of the heat exchanger panel, the burner assembly mounted to the heat exchanger panel by a first tab and a second tab, wherein the first tab and the second tab are configured to slide into (i) a first upper portion and a first lower portion of a front slot formed along a front surface of the heat exchanger panel, and wherein the first tab and the second tab are configured to pivot and slide into (ii) a second upper portion and a second lower portion of a side slot formed along a side surface of the heat exchanger panel; wherein the first tab and the second tab mount the burner assembly to the heat exchanger panel on an inner side of the burner assembly, and wherein a different fastener mounts the burner assembly to the heat exchanger panel on an outer side of the burner assembly;

wherein the first bracket is a side bracket of the burner assembly, wherein the side bracket is substantially parallel with the side surface of the heat exchanger panel.

8. The heating system of claim 7, wherein the first tab comprises a first upper tab that engages the first upper portion, and the second tab comprises a first lower tab that engages the first lower portion.

9. The heating system of claim 8, wherein the first tab fits into the first upper portion on the front surface of the heat exchanger panel, and the second tab fits into the second lower portion on the side surface of the heat exchanger panel.

10. The heating system of claim 7, wherein the burner assembly is partially enclosed by a side panel and a top panel mounted to the front surface of the heat exchanger panel, and an induction fan, wherein the side panel is mounted to a bottom of the heating system.

11. The heating system of claim 8, wherein the burner assembly comprises: an array of burners enclosed within a burner support, wherein the first bracket is attached to a first side of the burner support, and wherein the second bracket is attached to a second side of the burner support.

* * * * *